United States Patent [19]

Oltrogge

[11] 4,404,086

[45] Sep. 13, 1983

[54] RADIAL FLOW RETORTING PROCESS WITH TRAYS AND DOWNCOMERS

[75] Inventor: Robert D. Oltrogge, Wheaton, Ill.

[73] Assignee: Standard Oil Company (Indiana), Chicago, Ill.

[21] Appl. No.: 333,039

[22] Filed: Dec. 21, 1981

[51] Int. Cl.[3] ..... C10G 1/00; C10B 49/06; C10B 49/10; C10B 53/06

[52] U.S. Cl. ..... 208/11 R; 208/8 R; 201/31; 201/34

[58] Field of Search ..... 208/11 R, 8 R; 201/31, 201/34

[56] References Cited

U.S. PATENT DOCUMENTS

| | | | |
|---|---|---|---|
| 2,717,869 | 9/1955 | Turner | 208/11 R |
| 3,801,469 | 4/1974 | Essenhigh | 201/34 X |
| 4,133,739 | 1/1979 | Mitchell et al. | 208/8 R |
| 4,160,720 | 7/1979 | Seader et al. | 201/31 X |
| 4,183,800 | 1/1980 | Mitchell et al. | 208/8 R |
| 4,199,432 | 4/1980 | Tamm et al. | 208/11 A X |
| 4,293,401 | 10/1981 | Sieg et al. | 208/11 R |
| 4,332,669 | 6/1982 | Spars et al. | 208/11 R |

*Primary Examiner*—Delbert E. Gantz
*Assistant Examiner*—Glenn A. Caldarola
*Attorney, Agent, or Firm*—Thomas W. Tolpin; William T. McClain; William H. Magidson

[57] ABSTRACT

Solid heat carrier material and solid hydrocarbon-containing material, such as oil shale, tar sands or coal, are deflected be conical baffles into radially moving fluid beds which alternately flow radially outwardly and inwardly over a series of trays and downwardly into a series of peripheral and axial downcomers for a sufficient residence time to liberate hydrocarbons from the solid hydrocarbon-containing material. A fluidizing gas is injected upwardly into the beds to mix and fluidize most of the solids in the beds as well as to strip and transport the liberated hydrocarbons away from the beds for further processing downstream. Upright annular baffles can be positioned in the beds to minimize radial backmixing of solids and can also extend above the surface of the beds to minimize wave propagation. Any unfluidized coarse particles can be moved downwardly at an angle of inclination by gravity flow and jet deflectors.

24 Claims, 5 Drawing Figures

RADIAL FLOW RETORTING PROCESS WITH TRAYS AND DOWNCOMERS

BACKGROUND OF THE INVENTION

This invention relates to a process and system for retorting hydrocarbon-containing material, and more particularly, to a fluid bed process and system for retorting solid, hydrocarbon-containing material such as oil shale, coal and tar sand.

Researchers have now renewed their efforts to find alternate sources of energy and hydrocarbons in view of recent rapid increases in the price of crude oil and natural gas. Much research has been focused on recovering hydrocarbons from solid hydrocarbon-containing material such as oil shale, coal and tar sand by pyrolysis or upon gasification to convert the solid hydrocarbon-containing material into more readily usable gaseous and liquid hydrocarbons.

Vast natural deposits of oil shale found in the United States and elsewhere contain appreciable quantities of organic matter known as "kerogen" whih decomposes upon pyrolysis or distillation to yield oil, gases and residual carbon. It has been estimated that an equivalent of 7 trillion barrels of oil are contained in oil shale deposits in the United States with almost sixty percent located in the rich Green River oil shale deposits of Colorado, Utah, and Wyoming. The remainder is contained in the leaner Devonian-Mississipian black shale deposits which underlie most of the eastern part of the United States.

As a result of dwindling supplies of petroleum and natural gas, extensive efforts have been directed to develop retorting processes which will economically produce shale oil on a commercial basis from these vast resources.

Generally, oil shale is a fine-grained sedimentary rock stratified in horizontal layers with a variable richness of kerogen content. Kerogen has limited solubility in ordinary solvents and therefore cannot be recovered by extraction. Upon heating oil shale to a sufficient temperature, the kerogen is thermally decomposed to liberate vapors, mist, and liquid droplets of shale oil and light hydrocarbon gases such as methane, ethane, ethene, propane and propene, as well as other products such as hydrogen, nitrogen, carbon dioxide, carbon monoxide, ammonia, steam and hydrogen sulfide. A carbon residue typically remains on the retorted shale.

Shale oil is not a naturally occurring product, but is formed by the pyrolysis of kerogen in the oil shale. Crude shale oil, sometimes referred to as "retort oil," is the liquid oil product recovered from the liberated effluent of an oil shale retort. Synthetic crude oil (syncrude) is the upgraded oil product resulting from the hydrogenation of crude shale oil.

The process of pyrolyzing the kerogen in oil shale, known as retorting, to form liberated hydrocarbons, can be done in surface retorts in aboveground vessels or in situ retorts underground. In principle, the retorting of shale and other hydrocarbon-containing materials, such as coal and tar sand, comprises heating the solid hydrocarbon-containing material to an elevated temperature and recovering the vapors and liberated effluent. However, as medium grade oil shale yields approximately 20 to 25 gallons of oil per ton of shale, the expense of materials handling is critical to the economic feasibility of a commercial operation.

In order to obtain high thermal efficiency in retorting, carbonate decomposition should be minimized. Colorado Mahogany zone oil shale contains several carbonate minerals which decompose at or near the usual temperature atained when retorting oil shale. Typically, a 28 gallon per ton oil shale will contain about 23% dolomite (a calcium/magnesium carbonate) and about 16% calcite (calcium carbonate), or about 780 pounds of mixed carbonate minerals per ton. Dolomite requires about 500 BTU per pound and calcite about 700 BTU per pound for decomposition, a requirement that would consume about 8% of the combustible matter of the shale if these minerals were allowed to decompose during retorting. Saline sodium carbonate minerals also occur in the Green River formation in certain areas and at certain stratigraphic zones. The choice of a particular retorting method must therefore take into consideration carbonate decomposition as well as raw and spent materials handling expense, product yield and process requirements.

In surface retorting, oil shale is mined from the ground, brought to the surface, crushed and placed in vessels where it is contacted with a hot heat transfer carrier, such as hot spent shale, sand or gases, or mixtures thereof, for heat transfer. The resulting high temperatures cause shale oil to be liberated from the oil shale leaving a retorted, inorganic material and carbonaceous material such as coke. The carbonaceous material can be burned by contact with oxygen at oxidation temperatures to recover heat and to form a spent oil shale relatively free of carbon. Spent oil shale which has been depleted in carbonaceous material is removed from the retort and recycled as heat carrier material or discarded. The liberated hydrocarbons and combustion gases are dedusted in cylcones, electrostatic precipitators, filters, scrubbers or pebble beds.

Some well-known processes of surface retorting are: N-T-U (Dundas Howes retort), Kiviter (Russian), Petrosix (Brazilian), Lurgi-Ruhrgas (German), Tosco II, Galoter (Russian), Paraho, Koppers-Totzek, Fushum (Manchuria), Union rock pump, gas combustion and fluid bed. Process heat requirements for surface retorting processes may be supplied either directly or indirectly.

Directly heated surface retorting processes, such as the N-T-U, Kiviter, Fusham and gas combustion processes, rely upon the combustion of fuel, such as recycled gas or residual carbon in the spent shale, with air or oxygen within the bed of shale in the retort to provide sufficient heat for retorting. Directly heated surface retorting processes usually result in lower product yields due to unavoidable combustion of some of the products and dilution of the product stream with the products of combustion. The Fusham process is shown and described at pages 101–102, in the book *Oil Shales and Shale Oils,* By H. S. Bell, published by D. Van Norstrand Company (1948). The other processes are shown and described in the *Synthetic Fuels Data Handbook,* by Cameron Engineers, Inc. (second edition, 1978).

Indirectly heated surface retorting processes, such as the Petrosix, Lurgi-Ruhrgas, Tosco II and Galoter processes, utilize a separate furnace for heating solid or gaseous heat-carrying material which is injected, while hot, into the shale in the retort to provide sufficient heat for retorting. In the Lurgi-Ruhrgas process and some other indirect heating processes, raw oil shale or tar sand and a hot heat carrier, such as spent shale or sand, are mechanically mixed and retorted in a screw conveyor. Such mechanical mixing often results in high temperature zones conducive to undesirable thermal cracking as well as causing low temperature zones which result in incomplete retorting. Furthermore, in such processes, the solids gravitate to the lower portion of the vessel, stripping the retorted shale with gas causing lower product yields due to reabsorption of a portion of the evolved hydrocarbons by the retorted solids. Generally, indirect heating surface retorting processes result in higher yields and less dilution of the retorting product than directly heated surface retorting processes, but at the expense of additional materials handling.

Surface retorting processes with a moving bed are typified by the Lurgi coal gasification process in which crushed coal is fed into the top of a moving bed gasification zone and upflowing steam endothermically reacts with the coal. A portion of the char combusts with oxygen below the gasification reaction zone to supply the required endothermic heat of reaction. Moving bed processes can be disadvantageous because the solids residence time is usually long, necessitating either a very large contacting or reaction zone or a large number of reactors. Moreover, moving bed processes often cannot tolerate excessive amounts of fines.

Surface retorting processes with entrained beds are typified by the Koppers-Totzek coal process in which coal is dried, finely pulverized and injected into a treatment zone along with steam and oxygen. The coal is rapidly partially combusted, gasified, and entrained by the hot gases. Residence time of the coal in the reaction zone is only a few seconds. Entrained bed processes are disadvantageous because they require large quantities of hot gases to rapidly heat the solids and often require the raw feed material to be finely pulverized before processing.

Fluid bed surface retorting processes are particularly advantageous. The use of fluidized-bed contacting zones has long been known in the art and has been widely used in fluid catalytic cracking of hydrocarbons. When a fluid is passed at a sufficient velocity upwardly through a contacting zone containing a bed of subdivided solids, the bed expands and the particles are buoyed and supported by the drag forces caused by the fluid passing through the interstices among the particles. The superficial vertical velocity of the fluid in the contacting zone at which the fluid begins to support the solids is known as the "minimum fluidization velocity." The velocity of the fluid at which the solid becomes entrained in the fluid is known as the "terminal velocity" or "entrainment velocity." Between the minimum fluidization velocity and the terminal velocity, the bed of solids is in a fluidized state and it exhibits the appearance and some of the characteristics of a boiling liquid. Because of the quasi-fluid or liquid-like state of the solids, there is typically a rapid overall circulation of all the solids throughout the entire bed with substantially complete mixing, as in a stirred-tank reaction system. The rapid circulation is particularly advantageous in processes in which a uniform temperature and reaction mixture is desired throughout the contacting zone.

Typifying those prior art fluidized bed retorting processes, retorting processes with various types of baffles, deflectors or downcomers, fluid catalytic cracking processes, and similar processes are the Union Carbide/-Battelle coal gasification process, the fluid coker and flexicoking processes described at page 300 of the *Synthetic Fuels Data Handbook,* Cameron Engineers, Inc. (second edition, 1978) and those found in U.S. Pat. Nos. 1,546,659; 1,676,675; 1,690,935; 1,706,421; 2,471,119; 2,506,307; 2,518,693; 2,542,028; 2,582,711; 2,608,526; 2,626,234; 2,675,124; 2,700,644; 2,717,869; 2,726,196; 2,757,129; 2,788,314; 2,793,104; 2,813,823; 2,832,725; 2,901,402; 3,083,471; 3,152,245; 3,297,562; 3,318,798; 3,501,394; 3,640,849; 3,663,421; 3,803,021; 3,803,022; 3,841,992; 3,976,558; 3,980,439; 4,035,152; 4,064,018; 4,087,347; 4,125,453; 4,133,739; 4,137,053; 4,141,794; 4,148,710; 4,152,245; 4,188,184; 4,193,760; 4,210,491; 4,243,489. These prior art processes have met with varying degrees of success.

Prior art gas fluidized bed processes usually have a dense particulate phase and a bubble phase, with bubbles forming at or near the bottom of the bed. These bubbles generally grow by coalescence as they rise through the bed. Mixing and mass transfer are enhanced when the bubbles are small and evenly distributed throughout the bed. When too many bubbles coalesce so that large bubbles are formed, a surging or pounding action results, leading to less efficient heat and mass transfer.

A problem with many prior art fluidized bed processes is the long residence time at high temperatures which results in many secondary and undesirable side reactions such as thermal cracking, which usually increases the production of less desirable gaseous products and decreases the yield and quality of desirable condensable products. Therefore, in any process designed to produce the maximum yield of high quality condensable hydrocarbons, it is preferred that the volatilized hydrocarbons are quickly removed from the retorting vessel in order to minimize deleterious side reactions such as thermal cracking.

A further problem with many prior art fluidized bed processes is that they often have low lateral mixing and high backmixing resulting in poor plug flow, slow retorting rates and excessive bed volumes. Moreover, many prior art fluidized bed processes require excessively high fluidizing velocities and pressures. Some prior art fludizing processes even specify heat carrier material that is larger than the crushed raw oil shale particles.

It is therefore desirable to provide an improved fluid bed process which overcomes most, if not all, of the preceding problems.

SUMMARY OF THE INVENTION

An improved fluid bed process is provided to retort solid hydrocarbon-containing material, such as oil shale, coal and tar sand. In the novel process, solid hydrocarbon-containing material and solid heat carrier material are deflected by conical baffles into radialy moving fluid beds which alternately flow radially outwardly and radially inwardly over a series of trays and downwardly through a series of peripheral and axial downcomers for a sufficient residence time to liberate hydrocarbons from the solid hydrocarbon-containing material. A fluidizing gas is injected upwardly into the beds to mix and fluidize most of the solids in the beds as well as to strip and transport the liberated hydrocarbons away from the beds for further processing downstream. Because the radially moving beds flow generally transverse and crosswise to the upwardly moving stream of fluidizing gas, lower gas velocities and operating pressures can be used, and radial plug flow, retorting efficiency and product yield are increased.

In the preferred form, each outwardly moving bed spills into one or more overflow peripheral downcomers that extends above the bed's tray. The peripheral downcomers can be in the form of internal annular downcomers, external downcomers or one or more circular arrays of equally spaced external or internal downcomers that substantially approximate radial flow. Each inwardly moving bed spills into an axial or central downcomer, which can extend above the underlying tray. The beds move fluidly in the radial directon in response to the overflow and spilling of the fluidized solids into the downcomers.

The solids in the beds can be directed to flow below as well as above one or more upright annular baffles or weirs. The baffles or weirs can be imperforate or perforated and can extend above the top surface of the beds to minimize backmixing and wave propagation.

The trays of the retort can be inclined downwardly in the direction of flow to enhance gravity flow of larger, coarse solids. Jet deflectors can also be provided to enhance radial flow of larger solids. The larger solids can further be directed to gravitate to a lower bed through auxiliary downcomers, such as an internal downcomer or a bifurcated external downcomer.

In the illustrated embodiments, the conical baffles and central downcomers are aligned in vertical registration with each other along the vertical axis of the retort. In the preferred form, the radially moving beds are generally circular and circumferentially and concentrically surround the conical baffles and central downcomers. In one embodiment, the solids move radially over the trays through stepwise, staged fluid beds.

The fluidizing gas can be steam, light hydrocarbon gases that have separated from the liberated hydrocarbons, off-gases emitted during combustion of the retorted hydrocarbon-containing material in a combustor, nitrogen or hydrogen. The fluidizing gas can also be preheated above the minimum retorting temperature of the solid hydrocarbon-containing material before entering the retort to provide supplementary heat for retorting.

The solid heat carrier material is preferably spent hydrocarbon-containing material for maximum thermal efficiency, although other solid heat carrier material can also be used such as sand, ceramic balls or metal balls.

As used throughout this application, the terms "retorted" hydrocarbon-containing material, "retorted" solids, "retorted" particles or "retorted" shale refers to hydrocarbon-containing material, solids, particles or oil shale, respectively, which have been retorted to liberate hydrocarbons leaving a material containing carbon residue.

The terms "spent" hydrocarbon-containing material, "spent" solids, "spent" particles or "spent" shale as used herein mean retorted hydrocarbon-containing material, solids, particles or shale, respectively, from which essentially all of the carbon residue has been removed by combustion.

The term "fluid bed" as used herein means a bed of solid hydrocarbon-containing material and heat carrier material which is fluidized by a gas.

The term "normally liquid" is relative to the condition of the subject material at a temperature of 77° F. (25° C.) and a pressure of one atmosphere.

A more detailed explanation of the invention is provided in the following description and appended claims taken in conjunction with the accompanying drawings.

DETAILED DESCRIPTION OF THE PREFERRED EMBODIMENT

Figure 1:
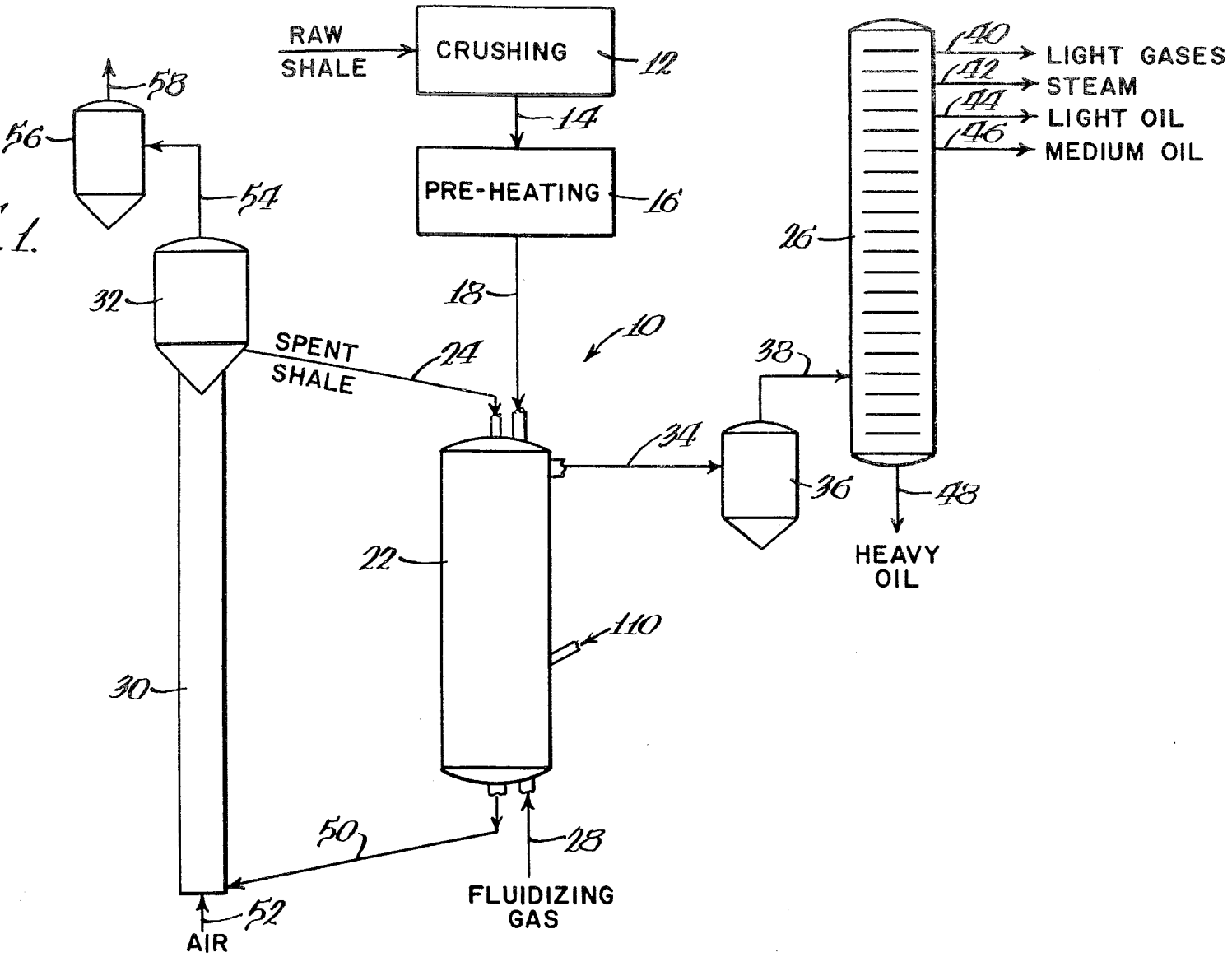
FIG. 1 is a schematic flow diagram of a retorting process in accordance with principles of the present invention.

Referring now to FIG. 1, a fluid bed process and system 10 is provided to retort hydrocarbon-containing material, such as oil shale, coal, tar sand, uintaite (gilsonite), lignite, peat and oil saturated diatomaceous earth (diatomite), for use in producing synthetic fuels. While the process of the present invention is described hereinafter with particular reference to the processing of oil shale, it will be apparent that the process can also be used to retort other hydrocarbon-containing materials such as coal, tar sand, uintaite (gilsonite), lignite, peat, and oil saturated diatomaceous earth (diatomite) etc.

In process and system 10, raw oil shale is fed to a crushing and screening station 12. The oil shale should contain an oil yield of at least 15 gallons per ton of shale particles in order to make the process and system self-sustaining in terms of energy requirements, so that the lift gas can consist essentially of liberated light hydrocarbon gases, steam or combustion gases from the system and the heat carrier material can consist essentially of spent oil shale from the system.

At the crushing and screening station 12, raw oil shale is crushed, sized and sorted by conventional crushing equipment such as an impact crusher, jaw pressure, jaw crusher, gyratory crusher, or roll crusher and by conventional screening equipment such as a shaker screen or vibrating screen and discharged into feed line 14. Oil shale particles less than one micron should be discarded or processed elsewhere because fine particles of that size tend to clog up the retort and hinder retorting. Oil shale particles greater than 10 mm should be recrushed because such particles can adversely effect fluidizing and retorting of smaller, oil shale particles.

The crushed oil shale particles in feed line 14 are conveyed to a preheating station 16 where the shale is preheated to between ambient temperature and 700° F. to dry off most of the moisture contained in the shale. Preferably, the crushed oil shale particles are preheated to a temperature from 250° F. to 600° F., and most preferably, from 300° F. to 400° F. to enhance efficiency of retorting. Oil shale temperatures over 700° F. should be avoided at this stage, because they may cause premature retorting. The preheating station 16 and the crushing and screening station 12 can be combined if desired.

The preheated, crushed oil shale particles are conveyed from preheating station 16 through one or more preheated oil shale feed line 18 by a screw conveyor or other conveying means, such as a lift elevator, gravity flow or conventional fluid conveying means, into an overflow fluid bed retort 22, which is sometimes referred to as a "fluidized bed" retort. Retort 22 has a generally cylindrical shape with a diameter substantially less than its overall height. The crushed raw oil shale particles are fed into retort 22 at a solids flux flow rate between 500 and 10,000 lbs/ft$^2$ hr, and preferably between 2,000 and 6,000 lbs/ft$^2$ hr for best results.

Heat carrier material, preferably spent oil shale, is fed from heat carrier line 24 into retort 22 at a temperature from a 1000° F. to 1400° F., preferably from 1100° F. to 1300° F., and most preferably from 1150° F. to 1250° F. for enhanced thermal efficiency. In the preferred embodiment, the raw oil shale and spent oil shale are introduced into the top portion of the retort. Heat carrier material in excess of 1400° F. should not be fed into the retort because it will decompose substantial quantities of carbonates in the oil shale. Heat carrier material below a 1000° F. should not be fed into the retort, if possible, because fine removal problems are aggravated and heat carrier input requirements are increased because of the high attrition rates at high recycle ratios.

The ratio of the solids flux flow rate of the heat carrier material (spent shale) being introduced into the retort by heat carrier line 24 to the solids flux flow rate of raw oil shale in lbs/ft$^2$ hr, fed into the retort by feed line 18 is in the range of from 2:1 to 10:1, and preferably from 3:1 to 5:1 for more efficient retorting.

In retort 22, the raw oil shale particles and spent shale are fluidized, entrained and mixed together so that the hot spent shale directly contacts and heats the raw oil shale particles to substantially retort all the raw oil shale particles. The effluent product stream of hydrocarbons liberated during retorting is emitted in the retort as a gas, vapor, mist or liquid droplets and most likely, a mixture thereof.

An inert fluidizing lift gas, such as steam or recycled light hydrocarbon gases which have been liberated from the oil shale during retorting and separated into a steam or light gas fraction in a separator 26 such as a "fractionator," also referred to as a "distillation column" or "fractionating column" is injected by a lift gas ejector 28 into the bottom of retort 22 into the radially moving fluid beds at a temperature between ambient temperature and 1000° F., preferably from 500° F. to 700° F., at a pressure from 1 psig to 50 psig, preferably 2 psig to 25 psig. In some circumstances it may be desirable to use raw or dedusted combustion offgases from combustor lift pipe 30 or combustion vessel 32, or hydrogen or nitrogen as the fluidizing gas.

Excessive fluidizing gas velocities should be avoided because they have a tendency to break apart the oil shale particles. The fluidizing gas velocity, however, must be great enough to provide enough lift to fluidize the majority of the oil shale and spent shale particles.

A molecular oxygen, combustion-supporting gas, such as air, should be avoided as a fluidizing gas in retort 22 because it could undesirably combust the liberated effluent product stream of hydrocarbons. Combustion of the raw oil shale particles and the liberated hydrocarbons is prevented in retort 22 by preventing an amount of molecular oxygen sufficient to support combustion from entering the retort.

The solids residence time, fluidizing gas velocity and pressure are correlated to allow retorting of substantially all the oil shale particles in retort 22 without substantial thermal cracking of the liberated hydrocarbons and substantially without carbonate decomposition.

The retorting temperature in retort 22 is in the range from 800° F. to 1200° F., preferably from 850° F. to 1050° F. Retorting temperatures above 1200° F. cause excessive carbonate decomposition. Retorting temperatures less than 1050° F. minimize thermal cracking of the liberated hydrocarbons. The retorting pressure in the top of retort 22 can be from atmospheric pressure to 20 psig or higher. The gas residence time and solids residence time in retort 22 are a function of the size and capacity of the retort, as well as the retorting temperature, pressure and flow rate of the fluidizing gas.

The effluent product stream of liberated hydrocarbons admixed with lift gas is withdrawn from the upper portion of retort 22 through product line 34 and partially dedusted in a cyclone 36. The dedusted hydrocarbons are discharged through overhead cyclone line 38 and separated into fractions of light gases, steam, light shale oil, middle shale oil and heavy shale oil in fractionating column 26. The light gases, steam, light shale oil, middle shale oil and heavy shale oil are withdrawn from fractionating column 26 through light gas line 40, steam line 42, light shale oil line 44, middle shale oil line 46 and heavy shale oil line 48, respectively. Heavy shale oil has a boiling point over 600° F. to 800° F. Middle shale oil has a boiling point over 400° F. to 500° F. and light shale oil has a boiling point over 100° F. The effluent oil and gases from fractionating column 26 can be dedusted further in downstream dedusting equipment and upgraded in a catalytic cracker or hydrotreater or otherwise processed downstream.

The retorted and spent oil shale particles are discharged from the bottom of retort 22 into a discharge line 50. The discharged particles gravitate through discharge line 50 into the bottom of an upright, dilute phase combustor lift pipe 30. Air or some other oxygen-containing combustion-sustaining lift gas is injected into the bottom of combustor lift pipe 32 through injector inlet 52 at a pressure and flow rate to fluidize, entrain, combust, propel, convey and transfer the retorted and spent oil shale particles upwardly through the lift pipe into an overhead combustor vessel or collection and separation bin 32. The combustion temperature in lift pipe 30 and overhead vessel 32 is from 1000° F. to 1400° F. Residual carbon contained on the retorted oil shale particles is substantially combusted in lift pipe 30 leaving spent shale for use as heat carrier material. The spent shale is discharged through an outlet in the bottom of overhead vessel 32 into heat carrier line 24 where it is conveyed by gravity flow into the top of retort 22.

The carbon contained in the retorted oil shale particles is burnt off mainly as carbon dioxide during combustion in lift pipe 30 and vessel 32 and together with the air and other products of combustion form combustion off-gases or flue gases which are withdrawn from the upper portion of vessel 32 through combustion gas line 54 and dedusted in a cyclone 56 or an electrostatic precipitator before being discharged through overhead line 58 into the atmosphere or processed further to recover additional steam for use as the lift gas in retort 22.

Figure 2:
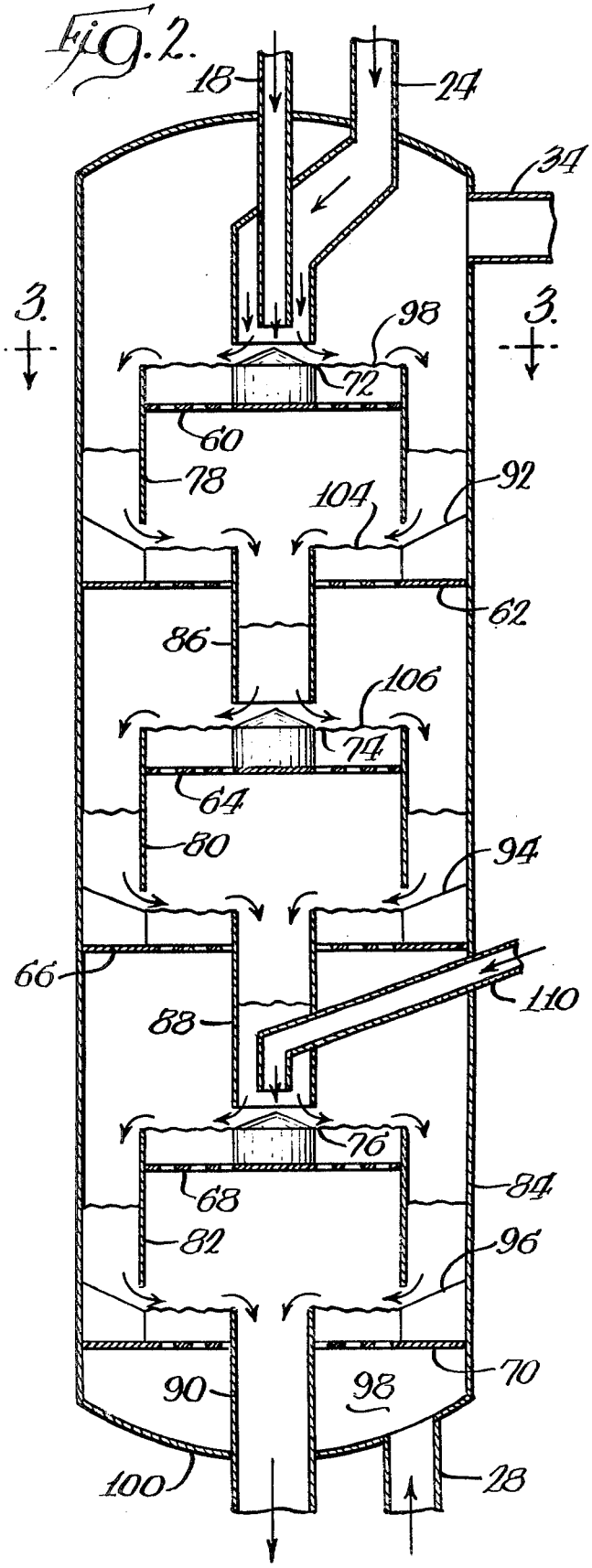
FIG. 2 is a cross-sectional view of a retort for use in the process.
Figure 3:
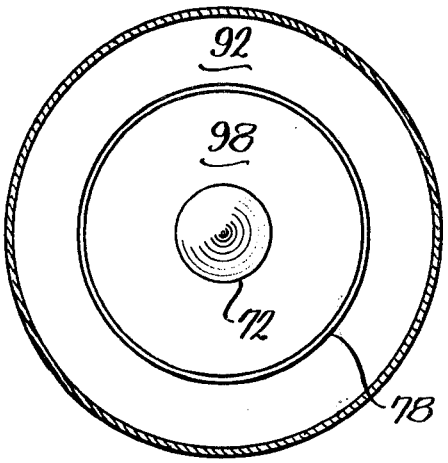
FIG. 3 is a fragmentary cross-sectional view taken substantially along line 3—3 of FIG. 2.

Referring now to FIGS. 2 and 3, a series of stationary foraminous trays or perforated distributor plates 60, 62, 64, 66, 68 and 70 extends diametrically and horizontally across the retort at equally spaced vertical intervals. In the illustrated embodiment, the trays are circular and generally planar or flat. Every other tray contains an upright stationary, axial conical baffle or deflector 72, 74 or 76 along the vertical axis of the retort as well as an annular, upright, internal, overflow peripheral downcomer 78, 80 or 82 in proximity to the upright peripheral wall 84 of the retort. Each conical baffle has a cylindrical or polygonal base and a conical head, hat or cap with an apex. Conical baffle 72 is located generally below feed lines 18 and 24. Each peripheral downcomer has an inlet or mouth that extends above the tray to which the downcomer is attached and an outlet that extends below the tray to which the downcomer is attached. A circular array of equally spaced internal peripheral downcomers can also be used in lieu of the annular downcomer to substantially approximate radial flow.

Every other intermediate tray 62, 66 and 70 contains a central, axial overflow downcomer 86, 88 or 90 along the vertical axis of the retort and an optional inwardly sloping, annular baffle or deflector 92, 94 or 96 below the outlet of a peripheral downcomer 78, 80 or 82. The central downcomers are aligned in vertical registration with the conical baffles 72, 74 and 76. Each central downcomer has a central inlet or mouth that extends above the tray to which the central downcomer is attached and has a central outlet that extends below the tray to which the central downcomer is attached.

In use, raw oil shale particles from line 18 are fed downwardly against and adjacent the apex of conical baffle 72 while spent oil shale particles (heat carrier material) from line 24 are deposited annularly upon and buries the raw oil shale particles covering the concial baffle. The conical baffle deflects the raw and spent oil shale particles radially outwardly and downwardly entirely around the conical baffle into a radially outwardly moving fluid bed 98 lying above tray 60. This feeding arrangement insulates the conical baffle 72 from the spent oil shale particles. If desired, this feeding arrangement can be reversed. The raw and spent oil shale particles can also be simultaneously fed at angles of inclination against the conical baffle.

Fluidizing lift gas is injected from gas line 28 into a plenum chamber or fluidizing chamber 98 located in the space between the bottom tray 70 and the bottom 100 of the retort and passes upwardly through holes, openings or fluid flow passageways in the trays into the radially moving fluid beds to fluidize a substantial amount of the particles in the beds so that the particles move and behave as if they were in a fluid stream. The fluidizing lift gas strips, transports and propels the liberated hydrocarbons upwardly and away from the particles above the fluid beds into an overhead outlet 34. The superficial gas velocity entering the retort is from one ft/sec to 8 ft/sec and most preferably from 3 ft/sec to 6 ft/sec for best results. Other superficial gas velocities can also be used. The fludizing velocity in the retort should be chosen in conjunction with particle size distribution of the raw shale feed and heat carrier solids to ensure adequate mixing and suspension of coarse shale particles on each tray.

As more oil shale particles enter the retort, fluid bed 98 gets higher. When the height of the fluid bed 98 reaches the lower lip or mouth of peripheral downcomer 78, excess particles will overflow and spill radially outwardly into the peripheral downcomer 78. The particles gravitate downwardly through the peripheral downcomer 78 and are deflected radially inwardly and downwardly as they exit downcomer 78 by deflector 92 into a radially-inwardly moving fluid bed 104 above tray 62. When the height of the fluid bed 104 reaches the upper lip or mouth of central downcomer 86, excess particles will overflow and spill radially inwardly into the central downcomer. The particles gravitate downwardly through central downcomer 86 until they are deflected radially outwardly and downwardly into a radially-outwardly moving fluid bed 106 by an intermediate conical baffle 74 and the above process is repeated for the other trays 66, 68 and 70. The downwardly moving bed of particles partially fills downcomers 78, 80, 82, 86, and 88 to minimize passage of the upwardly flowing fluidizing gas throughout the downcomers. Retorting commences as the raw oil shale particles contact the spent shale particles and is substantially completed in the retort before the particles are discharged from the bottom central downcomer 90. Supplementary spent shale can be fed into the retort, such as through central downcomer 88 by auxiliary heat carrier line 110, for additional heat, if desired.

The settled height of each bed is from 0.25 ft. to 6 ft and preferably from 1 ft to 3 ft. The ratio of the settled height of each bed to the radius of the retort is from 0.01 to 0.5 and preferably from 0.06 to 0.3 for better results.

The solids residence time per tray is from 0.1 min. to 5 min. and preferably from 0.4 min. to 2 min. The total solids residence time in the retort is from 1 minute to 10 minutes and preferably from 2 minutes to 5 minutes for optimum product yield.

Fluid bed retorting with radial flow has many advantages. Because the primary flow direction of the raw and spent shale particles through the bed is radial, the intrinsic low mixing of solids in the radial direction approaches plug flow with an increase in conversion of raw oil shale particles to liberated hydrocarbons for most residence times over conventional fluid bed retorts, which typically attempt to attain plug flow in the vertical direction. Thermal cracking and product degradation are minimized because hydrocarbons are stripped from the raw oil shale particles by the upwardly moving lift gas in a direction generally transverse to the laterally moving fluid bed. Because the fluidizing gas need only fluidize and suspend the oil shale particles in the fluid bed and need not lift the particles through the entire height of the retort, the fluidizing gas velocity of this process can be substantially lower than in conventional fluid bed retorts, which results in lower retorting pressures and substantial economic savings.

Radial flow retorting offers many advantages over conventional tray retorting where the solids travel across the entire diameter of each tray, by shortening the lateral distance the solids must travel across each tray to one-half or less than required in conventional tray retorting so as to reduce the hydraulic gradients, that can cause malfunction in large diameter equipment, to safe levels. Radial flow retorting also attains better lateral plug flow than conventional tray retorting. Higher lateral velocities and lower bed depths can also be used.

The ratio of bed height to bed radius for each tray is relatively low to permit smaller bed volumes and minimize fluid bed pressure drop, bubble growth and entrainment in the retort. Furthermore, multiplicity of pneumatic in-bed solids injection systems is not required nor does the raw oil shale have to be ground to the size of fluid catalytic cracking catalysts in order to achieve adequate solids mixing at relatively short residence times.

Figure 4:
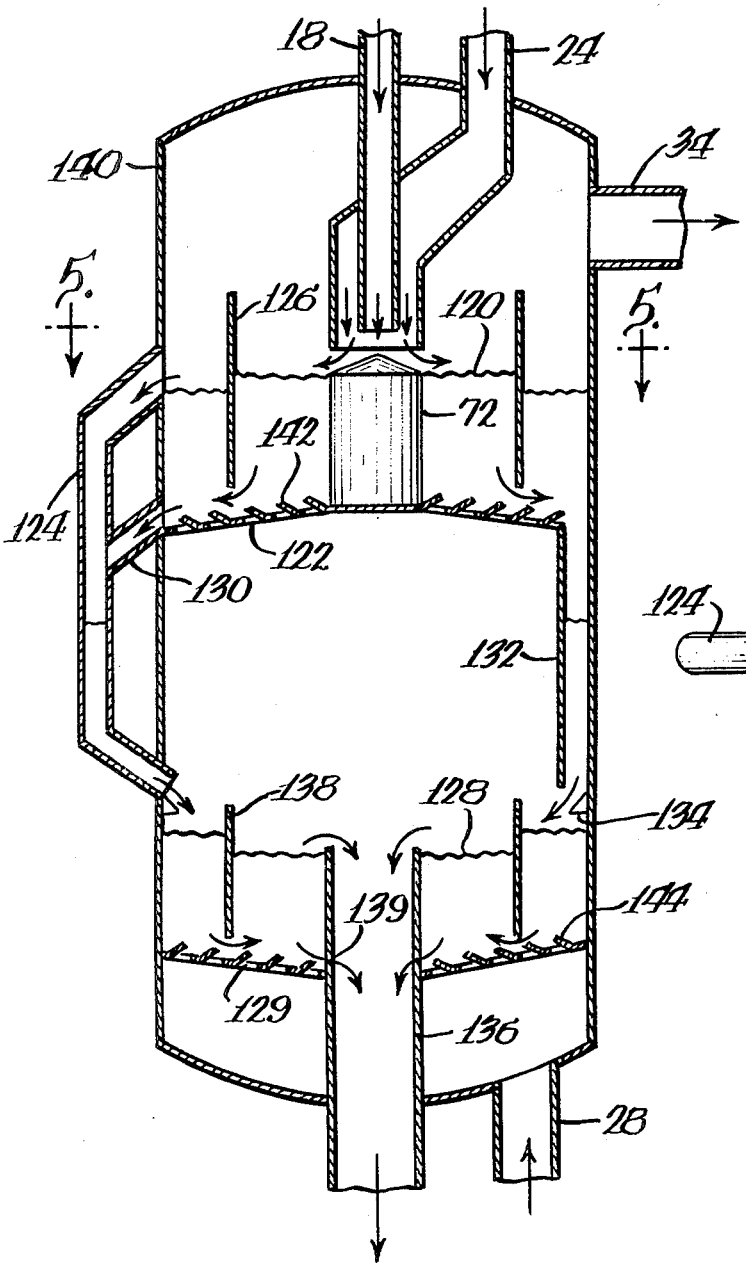
FIG. 4 is a cross-sectional view of another retort for use in the process.
Figure 5:
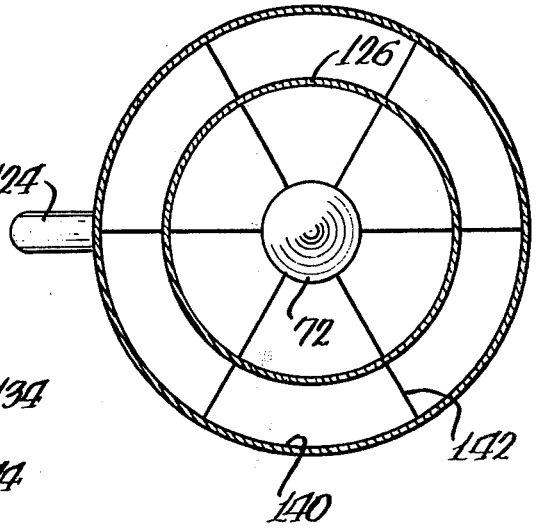
FIG. 5 is a fragmentary cross-sectional view taken substantially along line 5—5 of FIG. 4.

The retort and process shown in FIGS. 4 and 5 are similar in many respects to the retort and process shown in 2 and 3. For ease of understanding and clarity, similar parts and components have been given the same part numbers, such as conical baffle 72, feed lines 18 and 24, etc.

In the retort of FIGS. 4 and 5, raw and spent oil shale particles from feed lines 18 and 24, respectively, are fed downwardly against conical baffle 72 where they are deflected radially outwardly and downwardly about the conical baffle into a radially outwardly moving, stepwise, staged fluid bed 120 lying above tray 122. Concurrently, fluidizing gas is injected upwardly into the retort through injector 28.

As more oil shale particles enter the retort, fluid bed 120 gets higher. When the height of the bed 120 reaches the upper lip or mouth of the single, external peripheral, overflow downcomer 124, extending above tray 122, the particles will overflow and spill radially outwardly into the external downcomer 124 and flow radially outwardly, against and under an upright annular, underflow, baffle or weir 126. An annular external peripheral downcomer or a circular array of equally spaced external peripheral downcomers can also be used in lieu of the illustrated external downcomer to approximate radial flow. Any larger, coarse, unfluidized particles or sediment in bed 120 will drop into an external conduit 130 that communicates with external downcomer 124. The coarse particles and fluidized smaller particles gravitate downwardly through peripheral downcomer 124 into a radially inwardly moving, stepwise staged fluid bed 128 lying above tray 129.

An optional internal peripheral downcomer 132 which extends entirely below tray 122 can also be used with external conduit 130 and downcomer 124 to pass the fluidized and unfluidized particles downwardly into fluid bed 128. The downwardly moving bed of particles partially fills downcomers 124 and 132 to a level below conduit 130 to minimize passage of the upwardly flowing fluidizing gas through the downcomers without blocking the passage of course particles through conduit 132. In some circumstances it may be desirable to use internal downcomer 132 in lieu of the external conduit 130 and downcomer 124.

An inwardly sloping, annular deflector or baffle 134 is positioned below the peripheral downcomers to deflect the particles radially inwardly into fluid bed 128 as the particles exit the peripheral downcomers. An axial, central, internal overflow downcomer 136 is located along the vertical axis of the retort in general vertical alignment with conical baffle 72. In the illustrated embodiment, the central downcomer extends vertically above tray 129.

When the height of the fluid bed 128 reaches the upper lip or mouth of the central downcomer 136, excess particles will overflow and spill radially inwardly into the central downcomer and flow radially inwardly, against and under an upright annular, underflow baffle or weir 138. Any larger coarse, unfluidized particles will fall into inlet openings or apertures 139 in downcomer 136 about tray 129. The coarse particles and fluidized smaller particles gravitate downwardly through the central downcomer for further processing.

In lieu of the illustrated central downcomer 136, a central downcomer which extends entirely downwardly from the lower tray 129 can be used with an overhead annular downcomer-extender, baffle or wier. In such circumstances, the extender should be spaced above and aligned in vertical registration with the central downcomer, so that the smaller fluidized particles spill into the extender before gravitating through the central downcomer and any unfluidized, coarse particles fall into the central downcomer via the annular opening between the central downcomer and the extender.

Referring specifically now to the upright annular baffles 126 and 138 (FIGS. 4 and 5), annular baffles 126 and 138 are spaced above trays 122 and 129, respectively, and are secured to the peripheral upright wall of 140 of the retort and the base of conical baffle 72 or the upwardly extending portion of the central downcomer 136, respectively, by a crisscross arrangement of struts 142 (FIG. 5), or other means well known in the art. The annular baffles 126 and 138 minimize radial backmixing of solids and enhance radial plug flow. Use of the annular baffles also increases the conversion of raw oil shale to liberated hydrocarbons and decreases the volume of particle solids with minimal product degradation, without substantially interfering with the upward stripping of liberated hydrocarbons.

In the illustrative embodiment, the upright annular baffles 126 and 138 extend above the top surface of the fluid beds 120 and 128, respectively, to minimize wave propagation and are imperforate to prevent passage of particles therethrough. In some circumstances, it may be desirable that the annular baffles be perforated and/or entirely submerged below the top surfaces of the beds to permit passage and/or overflow of the particles.

In the retort of FIG. 4, trays 122 and 129 slope conically of frustro-conically downwardly in a generally convex or concave manner from one degree to 30 degrees in the direction of radial flow to enhance gravity flow of any unfluidized coarse particles into the downcomers. The sloping trays cooperate with the upright annular baffles to provide stepwise staged fluid beds 120 and 128, in which the height of the beds is progressively lowered in the direction of radial flow.

Trays 122 and 129 can also have upwardly extending jet deflectors 140 and 144 positioned slightly upwardly and downstream of the apertures or openings in the trays. Jet deflectors 140 and 144 are curved, hook-shaped or ramp-shaped to partially deflect the flow of fluidizing gas in the direction of radial flow to enhance radial flow of any unfluidized particles into the downcomers. Jet deflectors, downwardly sloping trays, and annular baffles can also be used in the retort and process of FIG. 2 if desired.

The operating parameters, trays, and tray spacing in the retort and process of FIG. 4 are similar to those described in the retort and process of FIG. 2, except that the superficial fluidizing gas velocity upon entering the retort of FIG. 4 is from 0.5 ft/sec to 4 ft/sec and most preferably from 1 ft/sec to 3 ft/sec. Other superficial gas velocities can also be used, depending on the size of the retort. The process of FIG. 4 provides advantages which are similar to the advantages described in the process of FIG. 2, as well as additional advantages.

While only two trays, and one external and central downcomer are shown in the retort of FIG. 4, the retort can also have the same number of trays and downcomers as those described with respect to the retort of FIG. 2.

The trays in the retorts of FIG. 2 and FIG. 4 are foraminous and can be in the form of perforated distributor plates, slotted trays, jet trays, disc donuts or bubble trays with optional bubble caps. Furthermore, while the preferred retorts and trays are circular in shape, it will be appreciated that other shaped retorts and trays can also be used.

Although embodiments of this invention have been shown and described, it is to be understood that various modifications and substitutions, as well as rearrangements of parts and combinations of process steps, can be made by those skilled in the art without departing from the novel spirit and scope of this invention.

What is claimed is:

1. A process for retorting oil shale, comprising the steps of:

(a) feeding raw oil shale particles generally downwardly about the vertical axis of an overflow fluid bed retort against a conical portion of a baffle located generally along the vertical axis of said retort;

(b) feeding spent oil shale particles generally downwardly at a temperature greater than the minimum retorting temperature of said row oil shale particles towards said conical portion of said baffle, concurrently with step (a);

(c) deflecting said raw and spent oil shale particles generally downwardly and radially outwardly off said conical portion into a radially outwardly moving fluid bed lying above a tray;

(d) overflowing said particles in said radially outwardly moving fluid bed over an upwardly extending mouth of and into at least one internal peripheral downcomer extending above said tray;

(e) radially moving said fluid bed generally outwardly above said tray from said conical portion to said peripheral downcomer in response to said overflowing in step (d);

(f) gravitatingly moving said particles downwardly through said peripheral downcomer to a radially inwardly moving fluid bed lying above another tray located below said first mentioned tray;

(g) overflowing said particles in said radially inwardly moving fluid bed over an upwardly extending mouth of and into a central downcomer generally along the vertical axis of said retort at a location above said other tray;

(h) radially moving said fluid bed generally inwardly from said peripheral downcomer over said other tray to said central downcomer in response to said overflowing in step (g);

(i) gravitatingly moving said particles downwardly through said central downcomer;

(j) repeating steps (c) through (i) for a plurality of trays for a sufficient time to liberate hydrocarbons from said oil shale particles;

(k) injecting fluidizing gas generally upwardly into said overflow retort separate and apart from said spent shale particles and in a direction generally opposite the feed direction of said spent shale particles to fluidize a substantial amount of said particles in said beds while preventing combustion in said retort and to strip and transport said liberated hydrocarbons upwardly and away from said particles into an outlet above said beds;

(l) conveying said particles from said retort to a combustor lift pipe; and (m) fluidizing, combusting and transporting said particles generally upwardly through said lift pipe with an oxygen-containing combustion-sustaining gas to provide spent oil shale particles for step (b).

2. A process in accordance with claim 1 including annularly overflowing said particles in said radially outwardly moving bed over the mouth and into an annular internal peripheral downcomer.

3. A process in accordance with claim 1 including radially overflowing said particles in said radially outwardly moving bed spill into a circular array of internal periphery downcomers.

4. A process for retorting oil shale, comprising the steps of:

(a) feeding raw oil shale particles generally downwardly about the vertical axis of an overflow fluid bed retort against a conical portion of a baffle located generally along the vertical axis of said retort (b) feeding spent oil shale particles generally downwardly at a temperature greater than the minimum retorting temperature of said raw oil shale particles towards said conical portion of said baffle, concurrently with step (a);

(c) deflecting said raw and spent oil shale particles generally downwardly and radially outwardly off said conical portion into a radially outwardly moving fluid bed lying above a tray in said retort;

(d) spilling said particles in said radially outwardly moving fluid bed radially outwardly over an upwardly extending lip of and into an external downcomer at a location generally above said tray in said retort;

(e) radially moving said fluid bed generally outwardly from said conical portion above said tray to said external downcomer in response to said spilling in step (d);

(f) gravitatingly moving said particles downwardly through said external downcomer to a radially inwardly moving fluid bed lying above another tray located below said first mentioned tray in said retort;

(g) spilling said particles in said radially inwardly moving fluid bed radially inwardly over an upwardly extending lip of and into a central downcomer located generally along the vertical axis of said retort;

(h) radially moving said fluid bed generally inwardly from said external downcomer to said central downcomer in response to said spilling in step (g);

(i) gravitatingly moving said particles downwardly through said central downcomer;

(j) said raw and spent oil shale particles moving together through said retort for a sufficient time to liberate hydrocarbons from said raw oil shale particles;

(k) injecting a fluidizing gas generally upwardly into said retort separate and apart from said spent shale particles and in a direction generally opposite the feed direction of said spent shale particles to fluidize a substantial amount of said particles in said beds while preventing combustion in said retort and to strip and transport said liberated hydrocarbons upwardly and away from said particles into an outlet above said beds;

(l) conveying said particles from said retort to a combustor lift pipe; and (m) fluidizing, combusting and transporting said particles generally upwardly through said lift pipe with an oxygen-containing combustion-sustaining gas to provide spent shale particles for step (b).

5. A process in accordance with claim 4 wherein said oil shale particles in said inwardly and outwardly moving beds move radially downwardly in a generally staged manner above said trays.

6. A process in accordance with claim 4 wherein said oil shale particles in said radial beds move radially against and under at least one generally upright annular baffle spaced above said trays.

7. A process in accordance with claim 6 wherein the height of said beds are kept below the top of said upright annular baffle to substantially prevent said beds from flowing over said upright annular baffle.

8. A process for retorting solid hydrocarbon-containing material, comprising the steps of:

radially moving a fluid bed of solid hydrocarbon-containing material and solid heat carrier material outwardly along a first tray in a retort;

spilling said radially outwardly moving bed into at least one downcomer located in general proximity to the periphery of the retort;

gravitatingly moving said bed downwardly through said downcomer;

radially moving said fluid bed inwardly along a second tray located generally below said first tray;

spilling said radially inwardly moving bed into a central downcomer located generally along the vertical axis of said retort;

gravitatingly moving said bed downwardly through said central downcomer;

said bed moving radially along said trays and downwardly through said downcomers for a sufficient time and at a sufficient temperature to liberate hydrocarbons from said solid hydrocarbon-containing material;

withdrawing said liberated hydrocarbons from said retort;

at least one of said trays being inclined downwardly in the direction of flow and some of said hydrocarbon-containing material moving downwardly by gravity flow at an angle of inclination along said inclined tray; and deflecting a fluidizing gas by jet deflectors extending from said inclined tray against some of said hydrocarbon-containing material to help move said hydrocarbon-containing material generally along said inclined tray.

9. A process in accordance with claim 8 wherein said solid materials are deflected by a generally conical deflector into said radially outwardly moving bed.

10. A process in accordance with claim 8 wherein said radially outwardly moving bed spills into at least one external downcomer.

11. A process in accordance with claim 8 wherein said peripheral downcomer extends partially above said first tray and said radially outwardly moving fluid bed spills into said peripheral downcomer at a location above said first tray.

12. A process in accordance with claim 8 wherein said central downcomer extends above said second tray and said inwardly moving bed spills into said central downcomer at a location above said second tray.

13. A process in accordance with claim 8 including moving said bed radially against and below at least one generally upright annular baffle.

14. A process in accordance with claim 8 wherein said solid hydrocarbon-containing material is selected from the group consisting of oil shale, tar sand, coal, peat, lignite, uintaite and oil saturated diatomaceous earth.

15. A process in accordance with claim 8 wherein said solid heat carrier material is selected from the group consisting of spent hydrocarbon-containing material, sand, ceramic balls and metal balls.

16. A process for retorting oil shale, comprising the steps of:

(a) feeding raw oil shale particles generally downwardly against a conical portion of a baffle located generally along the vertical axis of a retort;

(b) feeding spent oil shale particles at a temperature greater than the minimum retorting temperature of said raw oil shale particles generally downwardly towards said conical portion of said baffle, concurrently with step (a);

(c) deflecting said raw and spent oil shale particles generally downwardly and radially outwardly off said conical portion into an outwardly moving fluid bed lying above a tray;

(d) spilling said particles in said outwardly moving fluid bed into at least one internal peripheral downcomer extending above said tray;

(e) moving said fluid bed radially outwardly from said conical portion to said peripheral downcomer in response to said spilling in step (d);

(f) gravitatingly moving said particles downwardly through said peripheral downcomer to an inwardly moving fluid bed lying above another tray located below said first mentioned tray;

(g) spilling said particles in said inwardly moving fluid bed into a central downcomer generally along the vertical axis of said retort at a location above said other tray;

(h) moving said fluid bed radially inwardly from said peripheral downcomer to said central downcomer in response to said spilling in step (g);

(i) gravitatingly moving said particles downwardly through said central downcomer;

(j) repeating steps (c) through (i) for a plurality of trays for a sufficient time to liberate hydrocarbons from said oil shale particles;

(k) injecting fluidizing gas into said retort to fluidize a substantial amount of said particles in said beds while preventing combustion in said retort and to strip and transport said liberated hydrocarbons upwardly and away from said particles into an outlet above said beds;

(l) conveying said particles from said retort to a combustor lift pipe;

(m) fluidizing, combusting and transporting said particles generally upwardly through said lift pipe with an oxygen-containing combustion-sustaining gas to provide spent shale particles for step (b); and (n) feeding additional spent shale particles separately into one of said central downcomers.

17. A process in accordance with claim 16 wherein said particles are deflected radially inwardly by an annular baffle upon exiting said annular downcomer.

18. A process in accordance with claim 16 wherein said fluidizing gas is selected from the group consisting of steam, light hydrocarbon gases separated from said liberated hydrocarbons, hydrogen, nitrogen and off gases emitted from said combustion.

19. A process for retorting oil shale, comprising the steps of:

(a) feeding raw oil shale particles generally downwardly against a conical portion of a baffle located generally along the vertical axis of a retort;

(b) feeding spent oil shale particles at a temperature greater than the minimum retorting temperature of said raw oil shale particles generally downwardly towards said conical portion of said baffle, concurrently with step (a);

(c) deflecting said raw and spent oil shale particles generally downwardly and radially outwardly off said conical portion into an outwardly moving fluid bed lying above a tray in said retort;

(d) spilling said particles in said outwardly moving fluid bed into an external downcomer at a location generally above said tray in said retort;

(e) moving said fluid bed radially outwardly from said conical portion to said external downcomer in response to said spilling in step (d);

(f) gravitatingly moving said particles downwardly through said peripheral downcomer to an inwardly moving fluid bed lying above another tray located below said first mentioned tray in said retort;

(g) spilling said particles in said inwardly moving fluid bed into a central downcomer located generally along the vertical axis of said retort;

(h) moving said fluid bed radially inwardly from said external downcomer to said central downcomer in response to said spilling in step (g);

(i) gravitatingly moving said particles downwardly through said central downcomer;

(j) said raw and spent oil shale particles moving together through said retort for a sufficient time to liberate hydrocarbons from said raw oil shale particles;

(k) injecting a fluidizing gas into said retort to fluidize a substantial amount of said particles in said beds while preventing combustion in said retort and to strip and transport said liberated hydrocarbons upwardly and away from said particles into an outlet above said beds;

(l) conveying said particles from said retort to a combustor lift pipe;

(m) fluidizing, combusting and transporting said particles generally upwardly through said lift pipe with an oxygen-containing combustion-sustaining gas to provide spent oil shale particles for step (b);

(n) said trays sloping downwardly generally in the direction of flow and at least some larger particles moving downwardly by gravity flow at an angle of inclination along said trays; and (o) deflecting said fluidizing gas by jet deflectors against said larger particles to help move said larger particles along said trays.

20. A process in accordance with claim 19 wherein said central downcomer extends entirely below said other tray and said inwardly moving fluid bed overflows into an upright annular baffle defining an extender that is spaced slightly above and aligned in general vertical registration with said central downcomer.

21. A process in accordance with claim 19 wherein said central downcomer extends above said other tray and said inwardly moving fluid bed overflows into said central downcomer.

22. A process in accordance with claim 19 wherein said fluidizing gas is selected from the group consisting of steam, light hydrocarbon gases separated from said liberated hydrocarbons, hydrogen, nitrogen and off-gases emitted from said combustion.

23. A process in accordance with claim 19 wherein at least some of said larger particles spill into an internal downcomer located at the periphery of said first mentioned tray and gravitate through said internal inwardly moving fluid bed.

24. A process in accordance with claim 19 wherein at least some of said larger particles spill into an external conduit communicating with said external downcomer at the periphery of said first mentioned tray and gravitate downwardly through said external downcomer to said inwardly moving fluid bed.

* * * * *

UNITED STATES PATENT OFFICE

CERTIFICATE OF CORRECTION

Patent No. 4,404,086 Dated September 13, 1983

Inventor(s) OLTROGGE, ROBERT DAVID

It is certified that error appears in the above-identified patent and that said Letters Patent are hereby corrected as shown below:

Patent

| Column | Line | |
|---|---|---|
| 1 | 23 | "whih" should be --which-- |
| 4 | 54 | "radialy" should be --radially-- |
| 7 | 8 | "a" (delete) |
| 7 | 16 | "a" (delete) |
| 9 | 51 | "fludizing" should be -- fluidizing-- |
| 13 | 17 | "row" should be -- raw-- |
| 14 | 4 | "periphery" should be -- peripheral-- |
| 14 | 10 | after "retort" add --;-- |

Page 1, Item [73], "Assignee: Standard Oil Company (Indiana), Chicago, Ill." should be --Assignees; Standard Oil Company Chicago, Ill. and Gulf Oil Corporation, Pittsburgh, Pa.--

Signed and Sealed this

*Twenty-third* Day of *October 1984*

[SEAL]

*Attest:*

GERALD J. MOSSINGHOFF

*Attesting Officer*

*Commissioner of Patents and Trademarks*